United States Patent [19]

Sakurada

[11] 4,039,183

[45] Aug. 2, 1977

[54] WRIST EXERCISE AND STRENGTHENING DEVICE

[75] Inventor: Hiroshi Sakurada, Toyonaka, Japan

[73] Assignee: Ritshyo Kogyo Kabushiki Kaisha, Japan

[21] Appl. No.: 679,081

[22] Filed: Apr. 21, 1976

[51] Int. Cl.[2] ..... A63B 21/00; A63B 21/18

[52] U.S. Cl. ..... 272/67; 272/140; 272/143

[58] Field of Search ..... 272/67, 68, 126, 132, 272/135, 139, 140, 141, 142; 128/26, 77, 80 C, 80 F, 363, 364

[56] References Cited

U.S. PATENT DOCUMENTS 3,814,419 6/1974 Bjorklund et al. ..... 272/139

FOREIGN PATENT DOCUMENTS 479,873 5/1916 France ..... 128/77

111,276 11/1917 United Kingdom ..... 128/77

OTHER PUBLICATIONS

"The Journal of Bone and Joint Surgery;" Jan. 1956; p. 224.

"Braces Today" Newsletter of the Pope Foundation, Inc.; Jan. 1958; all four pp.

*Primary Examiner*—Richard C. Pinkham

*Assistant Examiner*—Arthur S. Rose

*Attorney, Agent, or Firm*—Armstrong, Nikaido & Marmelstein

[57] ABSTRACT

A device is provided for exercising and strengthening the human wrist, which comprises a concave trough with two parallel spaced members projecting from one end thereof and a grip rotatably mounted on the elongated member. Springs provide a force which rotates the grip away from the longitudinal axis of the concave trough. The device fits on the human forearm directly above the wrist and provides wrist strengthening exercises for the user by means of the grip being biased by the force of the springs against the flexing of the wrist.

6 Claims, 3 Drawing Figures

WRIST EXERCISE AND STRENGTHENING DEVICE

BRIEF DESCRIPTION OF THE INVENTION

The present invention relates to a device for strengthening and exercising the wrist and more particularly to a lightweight mechanism which fits on the human arm and is specifically designed to provide exercise exclusively for the wrist muscles.

An individual's performance in many types of sport is greatly enhanced by having strength in the wrist muscle. For example, strength in the wrist is important in the game of golf in order that the ball may be driven with maximum power and distance. Similarly, wrist strength is also desirable in baseball and tennis. Therefore, the strengthening of the individual's wrist is an important factor in obtaining excellence in a wide variety of sports, particularly those which emphasize the use of the upper extremities of the body such as the hands and arms.

Various devices have been used in the past for strengthening the wrist, such as, for example, barbells. However, because barbells depend entirely on the lifting of a weight, they are not a particularly advantageous way of strengthening the wrist muscles alone as they require the substantial use of arm muscle. Other devices which have been used in the prior art have also required the expenditure of great amounts of physical energy for manupulation without a corresponding strengthening of the wrist muscle or have been large and complex devices which were either too heavy or too expensive to provide a convenient and readily accessible means for exercising and strengthing the wrist.

Accordingly, it is an object of the present invention to provide an apparatus for strengthening exclusively the wrist muscles. It is a further object of the present invention to provide a device for strengthening the wrist muscle which is small in size and lightweight so that it can be easily held in one hand.

It is still a further object of the present invention to provide a device for exercising and strengthening the wrist muscles, which device easily attaches to the arm and contains a rotatable part which is moved by the hand against a spring force.

These and other objects are accomplished according to the present invention, whereby a device is provided for strengthening and exercising the wrist muscles which comprises an elongated, curved member which is shaped to fit the portion of the human arm directly above the wrist and to which is attached a gripping means for the hand which is rotated by natural movement of the wrist against a spring loaded force so that the back of the hand moves from a linear to angular position with respect to the longitudinal axis of the arm. More particularly, according to the present invention the hand grip is attached to projecting elements of the elongated, curved member by means of rotatable couplings which are spring-loaded to provide a force which acts against the hand grip in a longitudinal direction relative to the elongated member. Therefore, once the device is secured to the user's arm, muscle strengthening exercies is accomplished by exerting pressure against the hand grip in a direction opposite to the force exerted by the spring.

In one embodiment of the present invention, the elongated member essentially forms a concave trough or channel to receive the user's arm and is secured to the arm, for example, by means of a flexible strap. It is also desirable that the axis of rotation of the hand-grip be at the approximate position of the wrist joint. Generally, either a spiral or coil spring can be employed and should be of sufficient strength to provide a meaningful resistant force for the person using the device. Typically, such springs exert a force of about 5 to 20 kilograms.

The present invention will, however, be further understood and appreciated by considering the attached drawings which describe a preferred embodiment thereof.

DETAILED DESCRIPTION OF THE DRAWINGS

Figure 1:
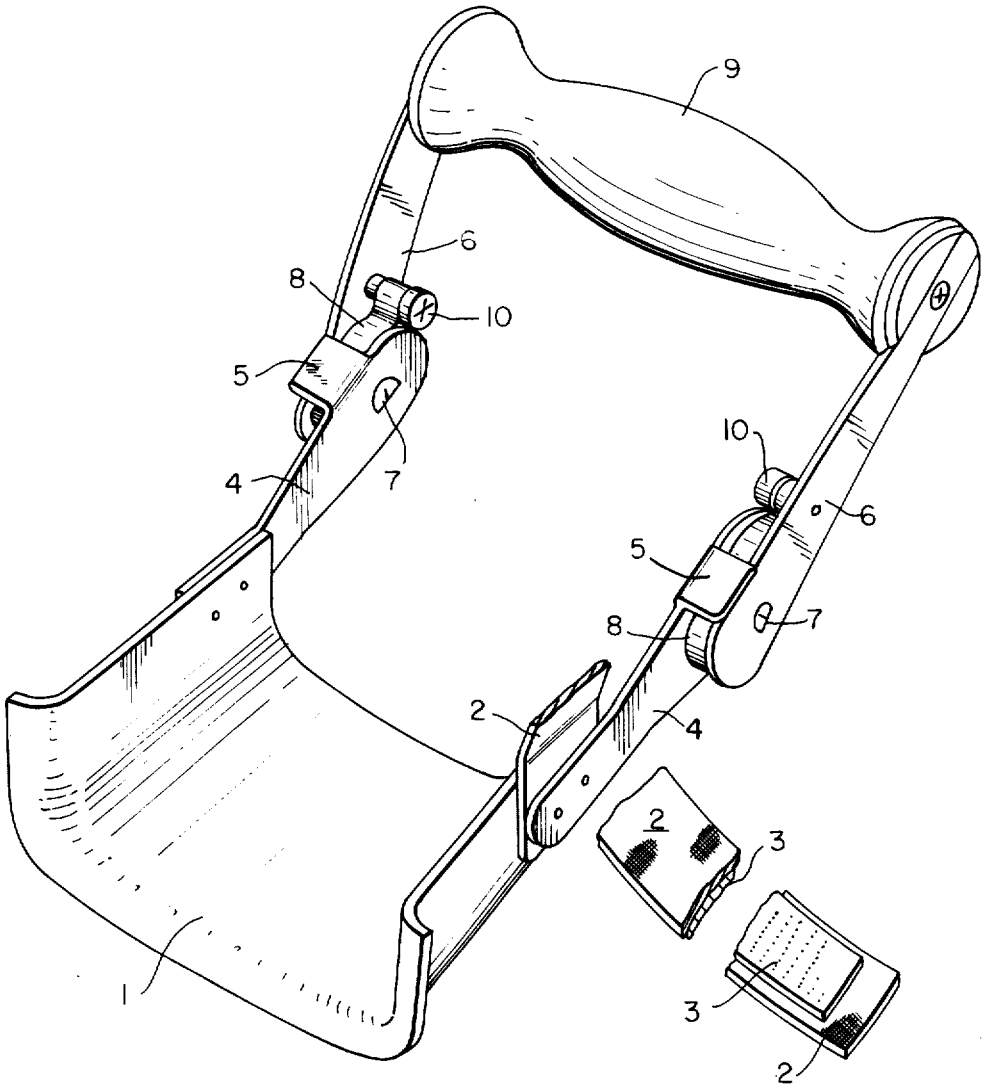
FIG. 1 is a perspective view of the device of the present invention in which the strap used for attaching the device to the arm is partially cut-away.

Turning to the Figures, it will be seen the elongated member 1 forms an open trough adapted to receive the human arm directly above the wrist. To this elongated member is attached a strap 2, which is adapted to flexibly pass over and around the individual's arm and secure it firmly to the elongated member 1. Advantageously, the strap can be secured by means of an adhesive substance 3, for example, VELCRO, as shown, or by means of conventional snap or buckle fasteners. In the particularly preferred embodiment which is shown, the strap 2 is provided of sufficient length that it can completely wrap around the wrist and the device to engage a similar type of adhesive material on the opposite side of the strap, thereby forming a secure closure. Projecting elements 4 extend longitudinally from either side of the elongated member 1. Twin arms 6 are rotatably attached to the terminal portions of the respective projections 4 by means of bolts or rivets shown at 7. The other ends of the arms 6 terminate in a handle 9 which is mounted transverse to the elongated member 1. Springs 8 are mounted at one end respectively on each of the projecting members 4 and at the other end of the spring to pins 10 which are attached to the arm 6, thereby providing a force which tends to rotate the hand and its attached arm in the plane of the longitudinal axis of the elongated member 1. Stops are provided at 5 on the projecting members 4 to prevent the arms 6 from being rotated by the force of the springs excessively away from a linear direction.

Figure 3:
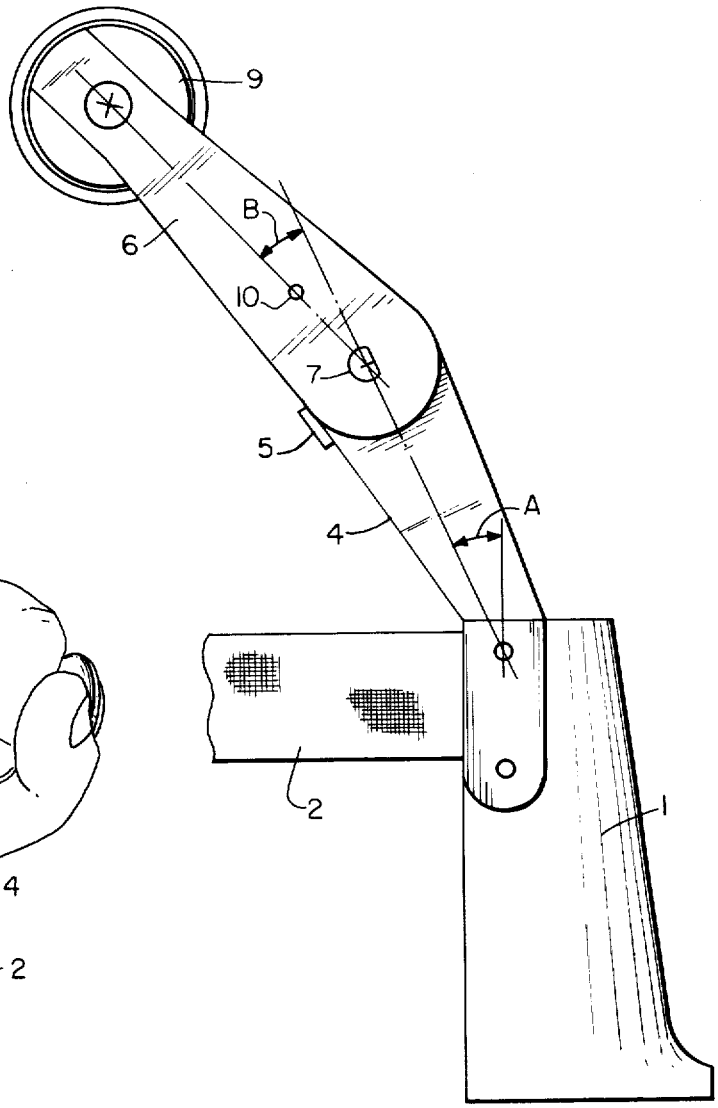
FIG. 3 is a side view of the device of the present invention.

Directing particular attention to FIG. 3, it will be seen that it is preferred that the projecting members 4 protrude from the elongated member 1 at an angle represented by A and that the arms 6 further extend from the projecting members 4 at an angle B. Preferably the angle A is between 10° and 45° and the angle B is between 0° and 30°, with the sum of angles A and B being between 30° and 60°. In the most preferred embodiment of the present invention angle A is 25° and angle B is 20°, which corresponds to the most advantageous position for exercising the human wrist muscles.

Figure 2:
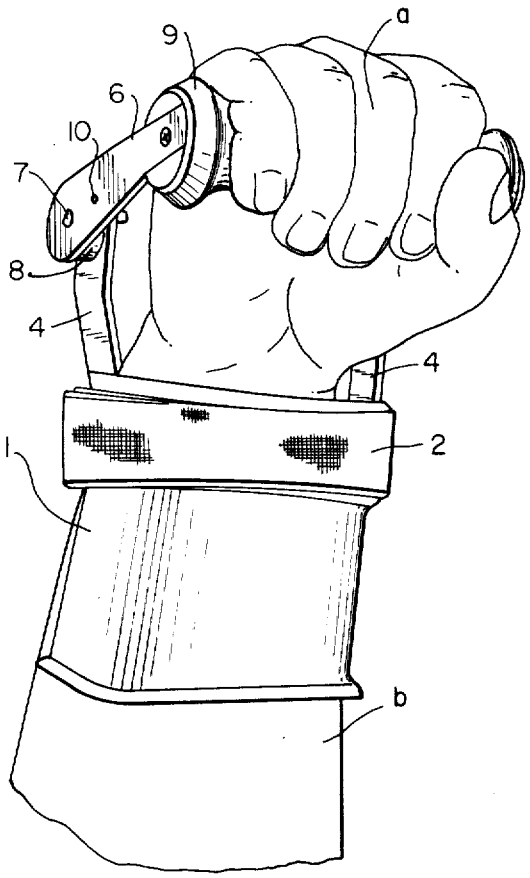
FIG. 2 is a perspective view showing the device of the present invention in use.

The use of the device of the present invention is illustrated in FIG. 2 and consists of placing the wrist into the trough-like elongated member 1 with the fingers in the direction of the grip 9 and the palm of the hand directed to the bottom of the elongated member 1 with the back of the hand to the open side of the concave elongated member. The user then grasps the grip 9 with the hand and wraps the band 2 around both the wrist and the outside of the elongated member 1, thereby securing the device to the user's wrist. In this manner, if the wrist is bent forward in the direction of the palm of the hand, the arms 6 rotate against the force of the springs 8. When the user, however, relaxes his effort in flexing his wrist forward, the force of the springs presses the handle backward so that the individual's wrist is bend somewhat back, but only so far as the stop 5 permits. Depending of course, upon the strength of the spring and the number of times that the individual repeats this operation, a considerable amount of exercise can be quickly and effectively provided for strengthening the wrist muscles. In one embodiment of the present invention, which is not illustrated herein, a conventional counter can be attached at the rotating juncture 7 to record the number of times that the individual flexes his wrist against the force of the device, thereby facilitating an orderly and regimented system of exercise.

It will, of course, be appreciated that the device of the present invention has the particular advantages of being small in size and inexpensive to produce and also is designed exclusively for exercising and strengthening the wrist muscles, and, therefore, does not require unneeded or undesirable exertion which does not contribute to this end and which for some individuals might be undesirable or impractical. It will further be appreciated that the device of the present invention can readily be constructed from a number of available materials, such as wood, metal or some plastics.

What is claimed is:

1. A device for exercising and strengthening the human wrist which comprises a concave, elongated trough adapted to fit on the human forearm immediately above the wrist, two spaced projecting members projecting from the ends of the respective sides of the trough parallel to the longitudinal axis of the trough and terminating in junctures with two rotatably mounted extending members which project generally in the same direction as said spaced, projecting members, said junctures being at a distance from said trough such that they coincide in position with the wrist of the user when the user's hand engages a common grip means and the trough is fitted on the forearm above the wrist, said extending members themselves terminating in said common grip means which is mounted at the ends thereof remote from said projecting members and transverse to said longitudinal axis of the trough, said extending members being biased away from a linear relationship with said projecting members by spring means disposed at the respective junctures of said extending and projecting members, and strap means attached to said elongated trough for securing the forearm therein.

2. The device of claim 1 which further includes stop means mounted on each of said projecting members for preventing the spring biased movement of said extending members beyond a predetermined point in relationship to said projecting member.

3. The device of claim 1 wherein each of said projecting members projects from said trough at an angle of between about 10° and 45° from the longitudinal axis thereof, and said extending members project from said projecting members at an angle of about 0° to 30° from the axis thereof, the sum of said angles being however about 30° to 60°.

4. The device of claim 3 wherein the angle of said projecting member is about 25° and said extending member is about 20°.

5. The device of claim 1 wherein said strap means extends transverse to the longitudinal axis of said trough and is of sufficient length to circumscribe both the users forearm and said trough in a winding relationship.

6. The device of claim 1 wherein said spring means has a force of about 5 to 20 kg.

* * * * *